US010173805B2

(12) United States Patent
Waddington

(10) Patent No.: US 10,173,805 B2
(45) Date of Patent: Jan. 8, 2019

(54) RECLOSABLE CARTON

(71) Applicant: Graphic Packaging International, Inc., Atlanta, GA (US)

(72) Inventor: Paul Waddington, Castleford (GB)

(73) Assignee: Graphic Packaging International, LLC, Atlanta, GA (US)

( * ) Notice: Subject to any disclaimer, the term of this patent is extended or adjusted under 35 U.S.C. 154(b) by 31 days.

(21) Appl. No.: 15/648,853

(22) Filed: Jul. 13, 2017

(65) Prior Publication Data

US 2018/0016054 A1 Jan. 18, 2018

Related U.S. Application Data

(60) Provisional application No. 62/362,279, filed on Jul. 14, 2016.

(51) Int. Cl.

| | |
|---|---|
| ***B65D 5/54*** | (2006.01) |
| ***B65D 5/42*** | (2006.01) |
| ***B65D 5/02*** | (2006.01) |
| ***B65D 85/00*** | (2006.01) |

(Continued)

(52) U.S. Cl.

CPC ..... *B65D 5/541* (2013.01); *B31B 50/26* (2017.08); *B65D 5/0209* (2013.01); *B65D 5/4266* (2013.01); *B65D 85/70* (2013.01); *B31B 2110/10* (2017.08)

(58) Field of Classification Search

CPC ..... B65D 5/541; B65D 85/70; B65D 5/4266; B65D 5/0209; B65D 5/3628; B65D 5/008; B65D 5/3678; B65D 5/6605; B31B 50/26; B31B 2110/10

USPC ..... 229/106, 402, 108.1, 117.05, 405; 383/15, 35

See application file for complete search history.

(56) References Cited

U.S. PATENT DOCUMENTS

| | | | |
|---|---|---|---|
| 83,812 | A | 11/1868 | Wilcox |
| 362,583 | A | 5/1887 | Jordan |
| 567,649 | A | 9/1896 | Lanzit |

(Continued)

FOREIGN PATENT DOCUMENTS

| | | |
|---|---|---|
| DE | 29 23 455 | 12/1980 |
| DE | 81 10 323.9 | 9/1981 |

(Continued)

OTHER PUBLICATIONS

International Search Report and Written Opinion for PCT/US2017/041887 dated Oct. 31, 2017.

*Primary Examiner* — Christopher Demeree

(74) *Attorney, Agent, or Firm* — Womble Bond Dickinson (US) LLP

(57) ABSTRACT

A carton for holding at least one article includes a plurality of panels and a plurality of end flaps. The plurality of panels at least partially defines an interior space of the carton, and includes a first side panel and a second side panel foldably connected to the first side panel. At least a portion of the first side panel and at least a portion of the second side panel are reconfigurable between an open position allowing access to the interior space and a closed position wherein the access to the interior space is restricted. The plurality of end flaps is respectively foldably connected to respective panels of the plurality of panels and form a closed end portion of the carton. The closed end portion is removable from the carton to allow access to the interior space.

50 Claims, 11 Drawing Sheets

(51) Int. Cl.
*B31B 50/26* (2017.01)
*B31B 110/10* (2017.01)

(56) References Cited

U.S. PATENT DOCUMENTS

| | | | |
|---|---|---|---|
| 1,082,868 | A | 12/1913 | Hollett |
| 1,772,625 | A | 8/1930 | Caulfield |
| 2,192,722 | A | 3/1940 | Vogt |
| 2,355,665 | A | 8/1944 | Mabee |
| 2,475,677 | A | 7/1949 | Ringler |
| 2,509,289 | A | 5/1950 | Dunning |
| 2,757,851 | A | 8/1956 | Moore |
| 3,133,688 | A | 5/1964 | Asman |
| 3,300,115 | A | 1/1967 | Schauer |
| 3,355,089 | A | 11/1967 | Champlin |
| 3,363,822 | A | 1/1968 | Maulini et al. |
| 3,426,955 | A | 2/1969 | Olson |
| 3,669,345 | A | 6/1972 | Cote |
| 3,680,766 | A | 8/1972 | Collura et al. |
| 3,690,544 | A | 9/1972 | Meyers |
| 3,768,719 | A | 10/1973 | Johnson |
| 4,191,324 | A | 3/1980 | Kitagawa |
| 4,252,267 | A | 2/1981 | Osborne |
| 4,313,553 | A | 2/1982 | Lisiecki |
| 4,344,537 | A | 8/1982 | Austin |
| 4,508,218 | A | 4/1985 | Focke et al. |
| 4,558,785 | A | 12/1985 | Gordon |
| 4,645,108 | A | 2/1987 | Gavin et al. |
| 4,676,394 | A | 6/1987 | Hiersteiner |
| 4,762,234 | A | 8/1988 | Wyberg |
| 4,905,898 | A | 3/1990 | Wade |
| 5,255,494 | A | 10/1993 | Doyle |
| 5,292,058 | A | 3/1994 | Zoss et al. |
| 5,326,024 | A | 7/1994 | Fogle |
| 5,347,865 | A | 9/1994 | Mulry et al. |
| 5,501,394 | A | 3/1996 | Eno |
| 5,632,402 | A | 5/1997 | Walsh et al. |
| 5,632,404 | A | 5/1997 | Walsh |
| 5,746,871 | A | 5/1998 | Walsh |
| 5,783,030 | A | 7/1998 | Walsh |
| 5,794,811 | A | 8/1998 | Walsh |
| 5,794,812 | A | 8/1998 | Walsh |
| 5,816,487 | A | 10/1998 | Skinner |
| 5,857,614 | A | 1/1999 | Walsh |
| 5,918,799 | A | 7/1999 | Walsh |
| 5,988,494 | A | 11/1999 | Fontaine |
| 5,996,882 | A | 12/1999 | Randall |
| 6,050,484 | A | 4/2000 | Galomb |
| 6,062,467 | A | 5/2000 | Ours et al. |
| 6,102,277 | A | 8/2000 | Krapohl, Sr. |
| 6,145,736 | A | 11/2000 | Ours et al. |
| 6,164,821 | A | 12/2000 | Randall |
| 6,206,279 | B1 | 3/2001 | Countee |
| 6,352,096 | B1 | 3/2002 | Walsh |
| 6,364,202 | B1 | 4/2002 | Zelley |
| 6,419,151 | B1 | 7/2002 | Urtubey |
| 6,854,639 | B2 | 2/2005 | Walsh |
| 6,929,172 | B2 | 8/2005 | Bates et al. |
| 7,025,504 | B2 | 4/2006 | Olin |
| 7,036,714 | B2 | 5/2006 | Walsh et al. |
| 7,210,612 | B2 | 5/2007 | Walsh et al. |
| 7,331,509 | B2 | 2/2008 | Bates et al. |
| 7,617,969 | B2 | 11/2009 | Oliveira |
| 7,913,897 | B2 | 3/2011 | Manaige |
| 8,672,214 | B2 | 3/2014 | Manaige |
| 8,770,469 | B2 | 7/2014 | Burke et al. |
| 9,346,582 | B2 | 5/2016 | Pinkstone |
| 9,758,275 | B2 * | 9/2017 | Fitzwater ..... B65D 5/103 |
| 9,771,176 | B2 * | 9/2017 | Kastanek ..... B65D 5/606 |
| 9,809,373 | B2 * | 11/2017 | Gallimore ..... B65D 81/3205 |
| 2001/0002677 | A1 | 6/2001 | Grabher |
| 2001/0048022 | A1 | 12/2001 | Zoeckler |
| 2002/0055429 | A1 | 5/2002 | Walsh |
| 2003/0144121 | A1 | 7/2003 | Walsh et al. |
| 2004/0102748 | A1 | 5/2004 | Hirotsu |
| 2004/0112948 | A1 | 6/2004 | Bone |
| 2004/0226989 | A1 | 11/2004 | Cook et al. |
| 2005/0127150 | A1 | 6/2005 | Walsh et al. |
| 2005/0187087 | A1 | 8/2005 | Walsh |
| 2005/0199695 | A1 | 9/2005 | DeBusk et al. |
| 2005/0209576 | A1 | 9/2005 | Hirotsu |
| 2005/0274782 | A1 | 12/2005 | Petrelli et al. |
| 2006/0054675 | A1 | 3/2006 | Bennett |
| 2006/0243783 | A1 | 11/2006 | Spivey, Sr. et al. |
| 2006/0255107 | A1 | 11/2006 | Wright |
| 2007/0194093 | A1 | 8/2007 | Ford |
| 2008/0296360 | A1 | 12/2008 | Abel et al. |
| 2015/0368019 | A1 | 12/2015 | Pinkstone |
| 2017/0113832 | A1 | 4/2017 | Faulkner |
| 2017/0225822 | A1 | 8/2017 | Cooper et al. |

FOREIGN PATENT DOCUMENTS

| | | | |
|---|---|---|---|
| DE | 87 08 078.8 | | 10/1987 |
| DE | 94 13 813 | | 10/1994 |
| EP | 1 457 425 | | 9/2004 |
| FR | 2 699 150 | | 6/1994 |
| FR | 2 755 670 | | 5/1998 |
| GB | 104445 | | 3/1917 |
| GB | 1 242 356 | | 8/1971 |
| GB | 1 489 963 | | 10/1977 |
| GB | 1 584 066 | | 2/1981 |
| GB | 2 363 372 | | 12/2001 |
| JP | 2009-137596 | A | 6/2009 |
| JP | 2010-013141 | A | 1/2010 |
| KR | 20-1998-0019 | | 7/1998 |
| KR | 10-0211329 | | 8/1999 |
| KR | 10-0354924 | | 10/2002 |
| KR | 10-2004-0004 | | 1/2004 |
| KR | 10-2005-0013 | | 2/2005 |
| KR | 10-2016-0058413 | A | 5/2016 |
| WO | WO 95/28325 | | 10/1995 |
| WO | WO 2006/124643 | | 11/2006 |
| WO | WO 2006/133401 | | 12/2006 |
| WO | WO 2007/050722 | A1 | 5/2007 |

* cited by examiner

RECLOSABLE CARTON

CROSS-REFERENCE TO RELATED APPLICATION

This application claims the benefit of U.S. Provisional Patent Application No. 62/362,279, filed on Jul. 14, 2016.

INCORPORATION BY REFERENCE

The disclosure of U.S. Provisional Patent Application No. 62/362,279, filed on Jul. 14, 2016, is hereby incorporated by reference for all purposes as if presented herein in its entirety.

BACKGROUND OF THE DISCLOSURE

The present disclosure generally relates to cartons having a reclosable configuration.

SUMMARY OF THE DISCLOSURE

According to one aspect of the disclosure, a carton for holding at least one article comprises a plurality of panels and a plurality of end flaps. Thea plurality of panels at least partially defines an interior space of the carton, and comprises a first side panel and a second side panel foldably connected to the first side panel. At least a portion of the first side panel and at least a portion of the second side panel are reconfigurable between an open position allowing access to the interior space and a closed position wherein the access to the interior space is restricted. The plurality of end flaps is respectively foldably connected to respective panels of the plurality of panels and form a closed end portion of the carton. The closed end portion is removable from the carton to allow access to the interior space.

According to another aspect of the disclosure, a blank for forming carton for holding at least one article, comprises a plurality of panels and a plurality of end flaps. The plurality of panels are for at least partially defining an interior space of the carton and comprises a first side panel and a second side panel foldably connected to the first side panel. At least a portion of the first side panel and at least a portion of the second side panel are reconfigurable between an open position allowing access to the interior space and a closed position wherein the access to the interior space is restricted when the carton is formed from the blank. The plurality of end flaps is respectively foldably connected to respective panels of the plurality of panels and are for forming a closed end portion of the carton when the carton is formed from the blank. The closed end portion is removable from the carton to allow access to the interior space when the carton is formed from the blank.

According to another aspect of the disclosure, a method of forming a carton for holding at least one article comprises obtaining a blank comprising a plurality of panels. The plurality of panels comprising a first side panel foldably connected to a second side panel, and the blank further comprising a plurality of end flaps respectively foldably connected to respective panels of the plurality of panels. The method further comprises folding the plurality of panels to at least partially define interior space of the carton and folding the plurality of end flaps to form a closed end portion that is removable from the carton to allow access to the interior space. The plurality of panels are folded such that at least a portion of the first side panel and at least a portion of the second side panel are folded into an open position allowing access to the interior space and the at least a portion of the first side panel. The at least a portion of the second side panel are folded to be reconfigurable into a closed position wherein access to the interior space is restricted.

According to another aspect of the disclosure, a method of forming a carton for holding at least one article comprises obtaining a blank comprising a plurality of panels. The plurality of panels comprising a first side panel foldably connected to a second side panel, and the blank further comprising a plurality of end flaps respectively foldably connected to respective panels of the plurality of panels. The method further comprises folding the plurality of panels to at least partially define interior space of the carton and folding the plurality of end flaps to form a closed end portion that is removable from the carton to allow access to the interior space. The plurality of panels are folded such that at least a portion of the first side panel and at least a portion of the second side panel are folded into an open position allowing access to the interior space and the at least a portion of the first side panel. The method further comprises reconfiguring the at least a portion of the first side panel and the at least a portion of the second side panel into a closed position wherein access to the interior spaces is restricted.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts may be designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles such as food products at least partially disposed within the carton embodiments. In this specification, the terms "lower," "bottom," "upper", "top", "front", and "back" indicate orientations determined in relation to fully erected cartons.

Figure 1:
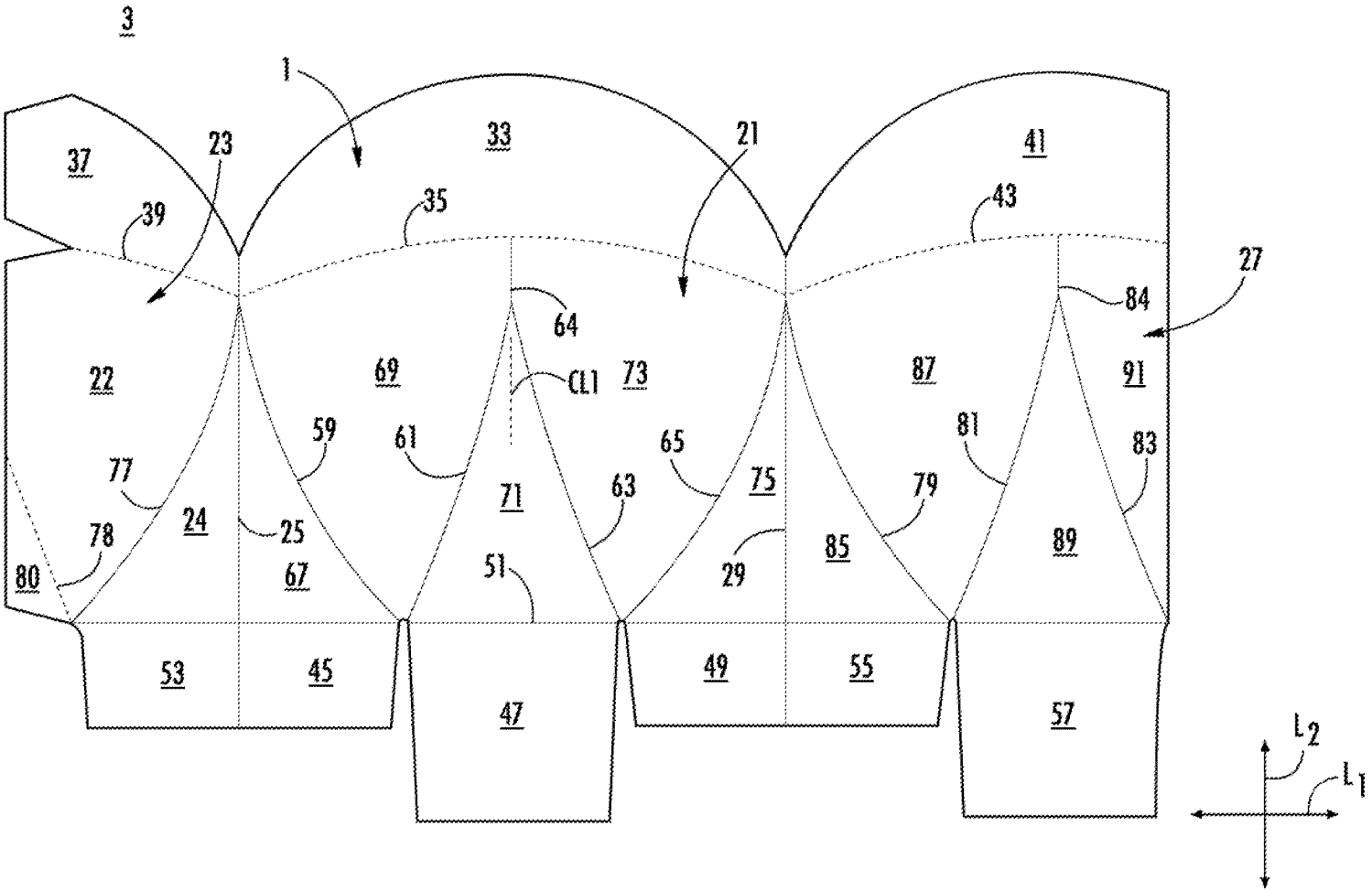
FIG. 1 is a plan view of a blank for forming a carton according to an exemplary embodiment of the disclosure.
Figure 6:
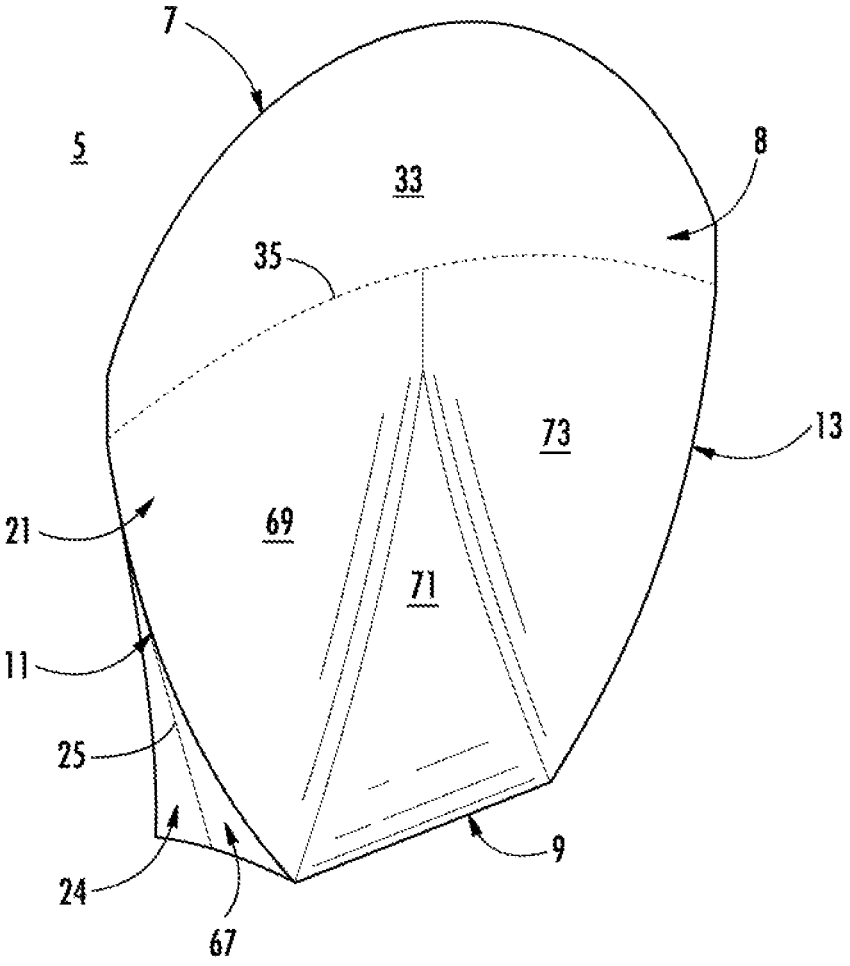
FIG. 6 is a perspective view of a carton formed from the blank of FIG. 1 according to an exemplary embodiment of the disclosure.

FIG. 1 is a plan view of the exterior side 1 of a blank, generally indicated at 3, that can be obtained and used to form a carton 5 (FIG. 6) according to exemplary embodiments of the disclosure. The carton 5 defines an interior space 6 (FIG. 7) in which one or more articles P (FIG. 4), e.g., a food product or other products, can be stored or held. The carton 5 has a top closed end portion 7 and a bottom closed end portion 9 (FIG. 6). As described herein, the top closed end portion 7 includes features that form a first closure 8 (FIG. 6) that can be removed to provide access to the interior of the carton 5, and the carton 5 is configured with features that form a second closure 10 (FIG. 10) for reclosing the carton 5 following removal of the first closure 8.

Figure 7:
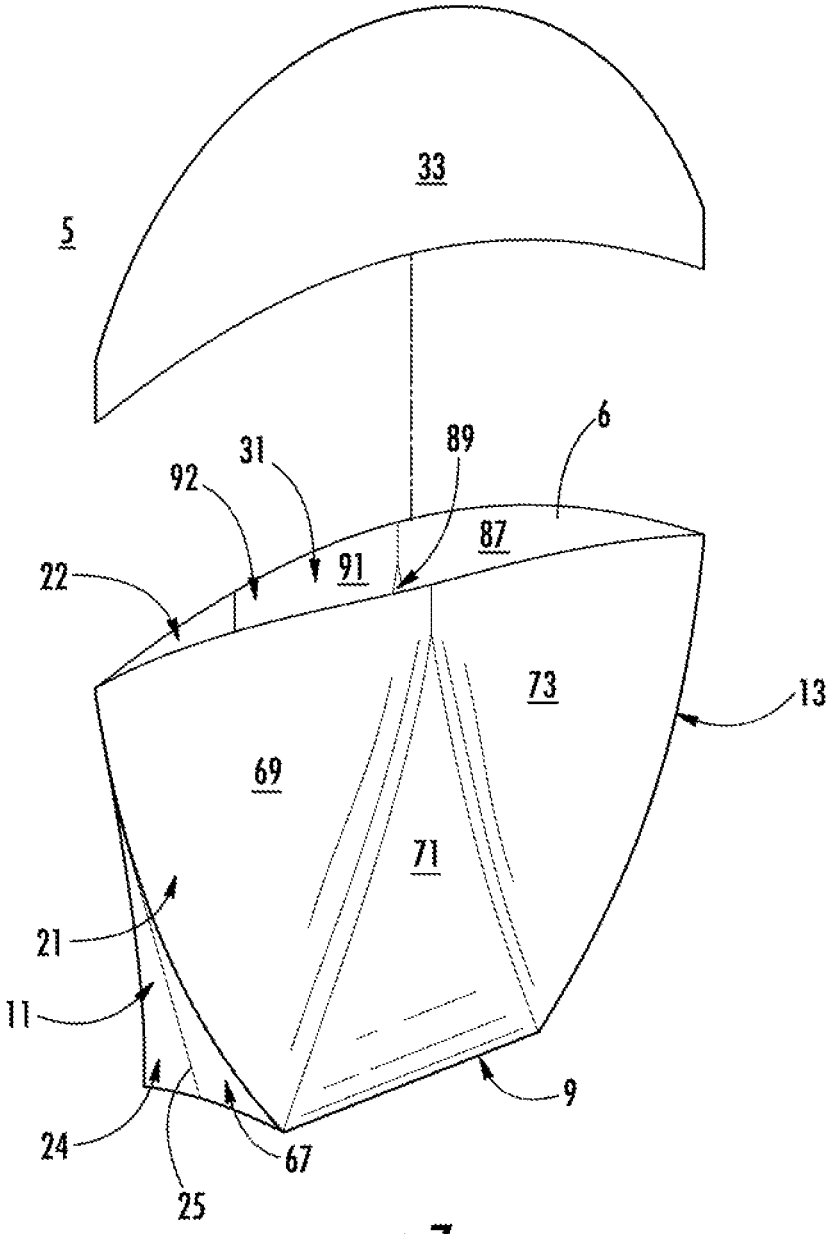
FIG. 7 is a perspective view of the carton of FIG. 6 with a closure removed.

As shown in FIG. 1, the blank 3 has a longitudinal axis L1 and a lateral axis L2. In the illustrated embodiment, the blank 3 includes a first side panel 21 foldably connected to a first side flap 23 and a second side flap 27 at respective first and second lateral fold lines 25, 29. As described further herein, the first side flap 23 and the second side flap 27 are joined to form a second side panel 31 of the carton 5 (FIG. 7).

In the illustrated embodiment, a top flap 33 is foldably connected to the first side panel 21 at a tear line 35, a top flap 37 is foldably connected to the first side flap 23 at a tear line 39, and a top flap 41 is foldably connected to the second side flap 27 at a tear line 43. As shown, the tear lines 35, 39, 43 may have a curved configuration, e.g., convex as shown. As described herein, the top flaps 37 and 41 are joined to form a top flap 42 (FIG. 3) of the carton 5 (FIG. 6).

As shown, bottom flaps 45, 47, and 49 are foldably connected to the first side panel 21 at portions of a longitudinal fold line 51, a bottom flap 53 is foldably connected to the first side flap 23 at a portion of the fold line 51, and bottom flaps 55 and 57 are foldably connected to the second side flap 27 at portions of the fold line 51. The bottom flaps 47 and 57, as illustrated, may protrude further from the respective first side panel 21 and second side flap 27 than the bottom flaps 45, 49, 53, and 55. The bottom flaps 45, 53 and 49, 55 as shown, may be foldably connected to one another at portions of the respective fold lines 39, 43.

In this regard, the top flaps 37, 33, 41 extend along a first or top marginal area of the blank 3, and the bottom flaps 53, 45, 47, 49, 55, 51 extend along a second or bottom marginal area of the blank 3. It will be understood that the fold lines 35, 39, 43, 51, the flaps 45, 47, 49, 53, 55, 57, and/or other portions of the blank 3 may be otherwise shaped or configured without departing from the disclosure.

Still referring to FIG. 1, the first side panel 21 includes fold lines 59, 61, 64, 63, 65 which form sections 67, 69, 71, 73, 75 of the first side panel 21, with section 71 being a central section, sections 69 and 73 being side sections, and sections 67 and 75 being end sections. Each fold line 59, 61, 64, 63, 65 may have a curved configuration, as shown, with fold lines 59, 65 disposed in a convex configuration and fold lines 61, 63 disposed in a concave configuration with respect to a vertical centerline CL1 extending in the lateral direction L2 through the section 71 of the first side panel 21. As also shown, the fold line 59 intersects the fold lines 25, 51 and the tear line 35, the fold line 61 intersects the fold lines 59, 51 and intersects the fold line 63 at a joined fold line 64 that intersects the tear line 35, and the fold line 65 intersects the fold lines 63, 29 and the tear line 35.

The side flap 23 also includes a fold line 77 having a curved configuration which intersects the fold line 25, the tear line 39, and the fold line 51, as shown in FIG. 1, to form sections 22, 24 of the side flap 23. The fold line 77 has a concave configuration with respect to the vertical centerline CL1, as shown. As also shown in FIG. 1, the first side flap 23 includes an oblique fold line 78 forming a folding tab 80 that can form an adhesive flap upon assembly of the blank 3 into the carton 5 (FIG. 7).

As illustrated, the side flap 27 includes fold lines 79, 81, 84, and 83 that form sections 85, 87, 89, and 91 of the side flap 27, with section 89 being a central section and sections 85 and 24 being end sections. As described further herein, upon formation of the carton 5 (FIG. 6), the section 22 of the first side flap 23 and the section 91 of the second side flap 27 will together form a section 92 of the second side panel 31 (FIG. 7), with sections 87 and 72 being side sections. As shown, the fold lines 79, 81, 83 have a curved configuration, with the fold lines 79 and 83 having a concave configuration with respect to the vertical centerline CL1 and the fold line 81 having a convex configuration with respect to the vertical centerline CL1. As illustrated in FIG. 1, the fold line 79 intersects the fold lines 29, 51, 81 and the tear line 43, the fold line 81 intersects the fold line 51 and intersects the fold line 83 to form a fold line 84 that intersects the tear line 43, and the fold line 83 intersects the fold line 81.

In this regard, the sections 67, 69, 73, 75 and 85, 87, 92, 24 of the respective side panels 21, 31 are foldably reconfigurable via respective fold lines 59, 61, 64, 63, 65 and 79, 81, 84, 83, 77 such that portions of the side panels 21, 31 are reconfigurable between an outwardly protruding configuration or open position and an inwardly protruding or recessed configuration or closed position when the carton 5 (FIG. 6) is formed, as described further herein.

Figure 2:
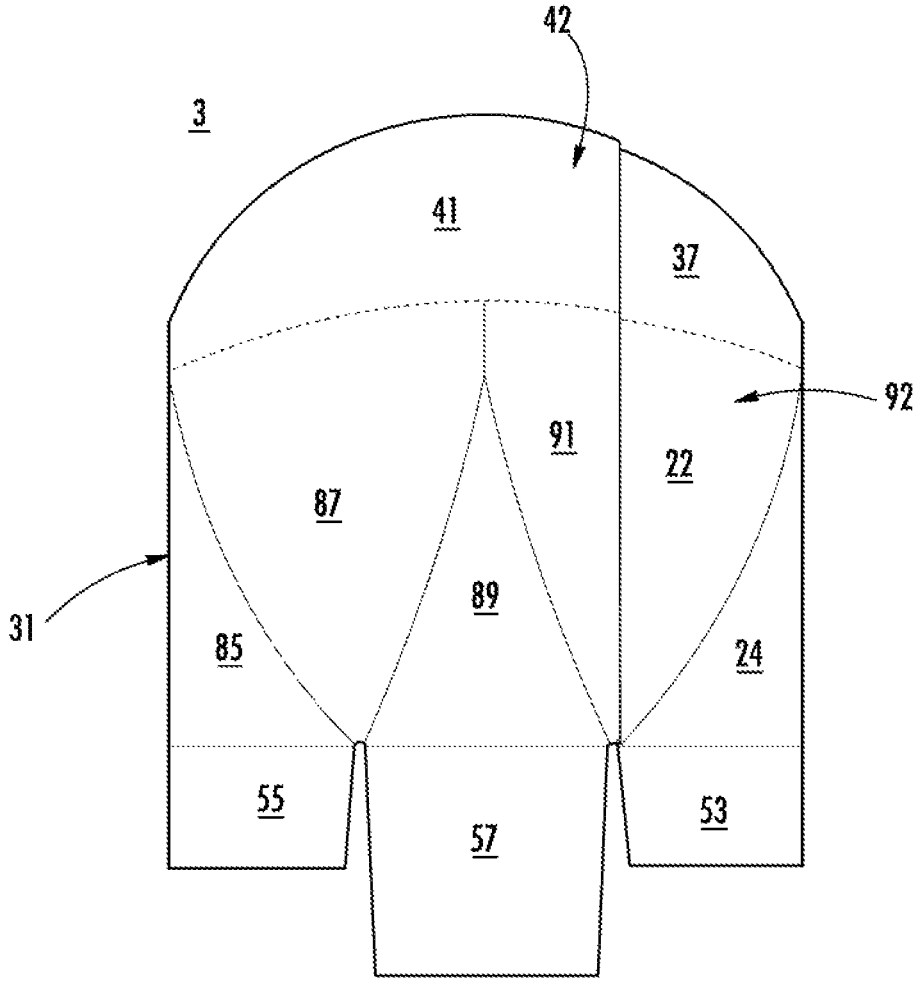
FIG. 2 is a first sequential perspective view of an assembly of the blank of FIG. 1 according to an exemplary embodiment of the disclosure.

Referring additionally to FIG. 2, as illustrated, the blank 3 can be partially folded such that the first side flap 23 and the second side flap 27 are at least partially overlapped in face-to-face contact such that the first side flap 23 and the second side flap 27 are secured to one another to form the second side panel 31 and the top flaps 37, 41 are at least partially overlapped in face-to-face contact such that the top flap 42 is formed. In this regard, one or more adhesives may be applied to portions of the first side flap 23, the top flap 42, and/or the second side flap 27 to effect securing of the side flaps 23, 27 and top flaps 37, 41 to one another.

Figure 3:
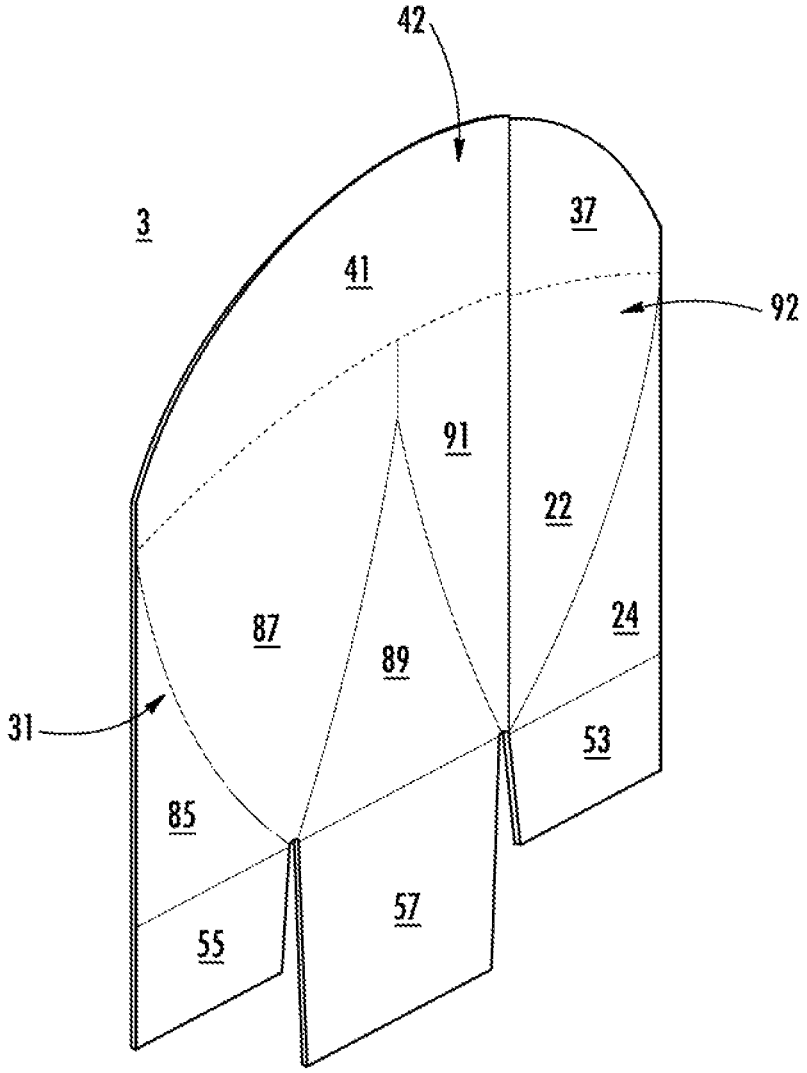
FIG. 3 is a second sequential perspective view of an assembly of the blank of FIG. 1 according to an exemplary embodiment of the disclosure.

Referring additionally to FIG. 3, the top flaps 33, 42 can be secured to one another, for example, with an adhesive such as glue applied along portions of the top flaps 33, 42, such that the top flaps 33, 42 are in at least partial face-to-face contact and the closed top 7 of the carton 5 is formed, as shown. The blank 3 in such a partially-erected form of the carton 5 (FIG. 6) may be inverted prior to, during, or following such securing of the top flaps 33, 42 to one another.

Figure 4:
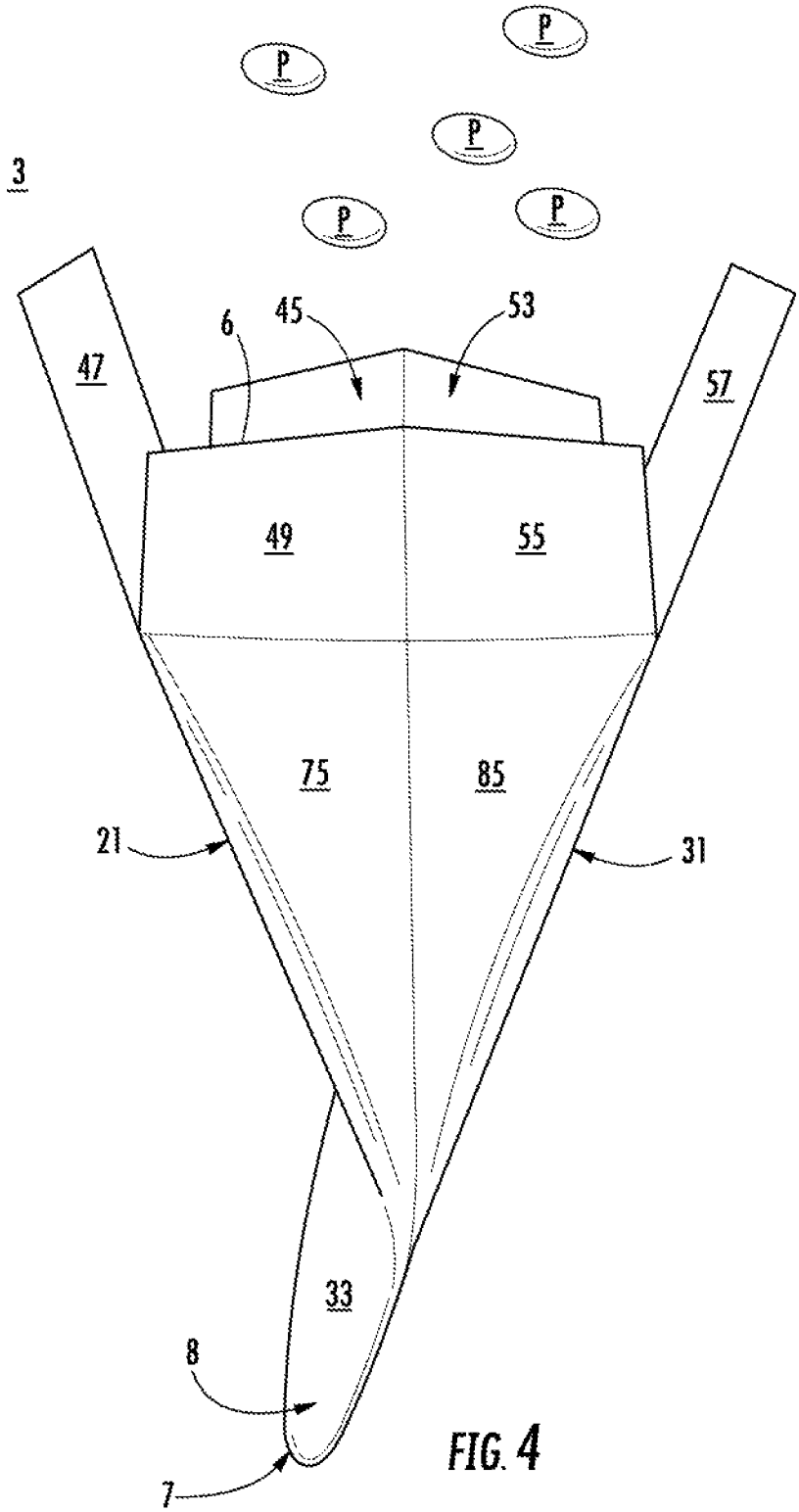
FIG. 4 is a third sequential perspective view of an assembly of the blank of FIG. 1 according to an exemplary embodiment of the disclosure.

Turning to FIG. 4, the side panels 21, 31 can be at least partially separated from one another, for example, manually or with a folding apparatus, such that an interior space 6 of the carton 5 is formed. In such an arrangement, one or more articles P can be stored in the interior space 6, and which may be supported by the closed top 7. Articles P may be, for example, loaded manually or with a loading apparatus, and multiple articles P may be held in the carton 5 in a separate arrangement or may be grouped, for example, with a liner, bag, or other packaging.

Figure 5:
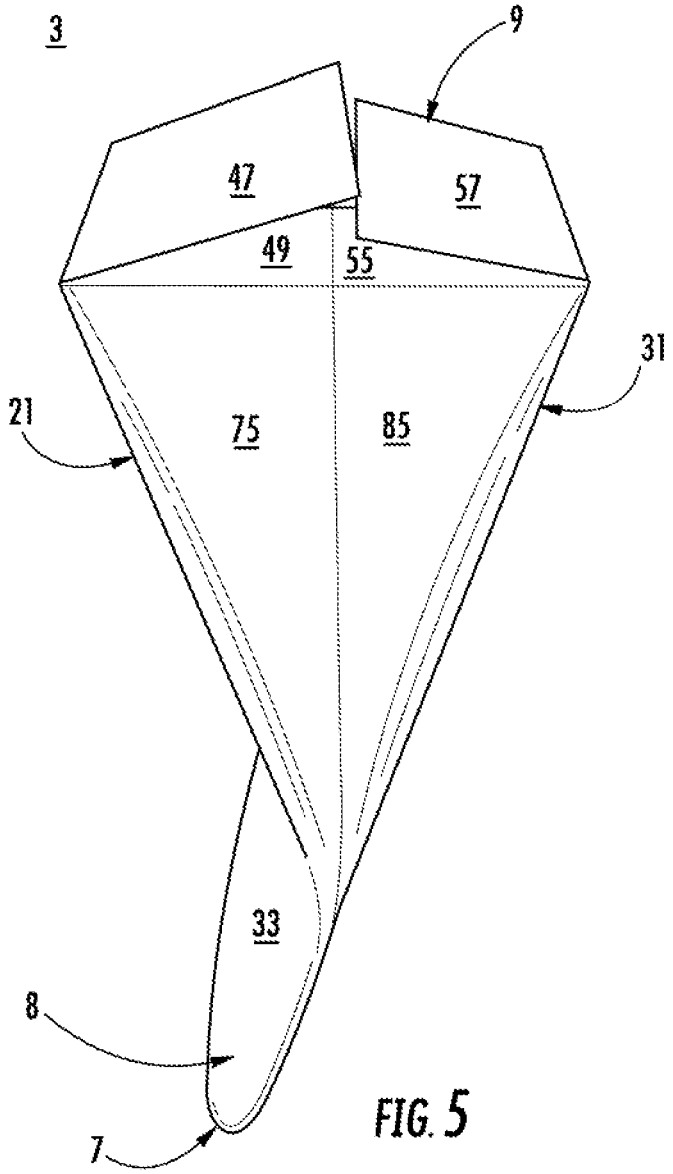
FIG. 5 is a fourth sequential perspective view of an assembly of the blank of FIG. 1 according to an exemplary embodiment of the disclosure.

Referring additionally to FIG. 5, following placement of the articles P in the interior space 6 of the partially-formed carton 5, the bottom flaps 53, 45, 47, 49, 55, 57 can be folded at respective portions of the fold line 51 overlapped upon one another to form the bottom closed end portion 9 of the carton 5. One or more of the bottom flaps 53, 45, 47, 49, 55, 57 may be adhered to one another to maintain a secure closure of the bottom closed end portion 9 of the carton 5. In such an arrangement, the spacing of the bottom flaps 53, 45, 47, 49, 55, 57 can maintain the separation of the side panels 21, 31. It will be understood that alternative closures, e.g., slots and tabs, can maintain the bottom closed end portion 9 of the carton 5 without departing from the disclosure. While the carton 5 has been shown loaded with articles P prior to closure of the bottom closed end portion 9, articles P can be loaded into the carton 5 prior to closure of the top closed end portion 7.

Turning to FIG. 6, and with continued reference to FIG. 1, the carton 5 is shown in a configuration in which the side panels 21, 31 have the outwardly protruding configuration or open position, e.g., with the central sections 71 and 89 of the respective first side panel 21 and second side panel 31 in parallel relation and with the respective sections 69, 73 and 87, 92 disposed obliquely inwardly therefrom. As shown, the sections 69 and 92 are disposed in oblique relation with respect to the fold line 25, and the sections 73 and 87 are disposed in oblique relation with respect to the fold line 29. As also shown, the sections 24, 67 and the sections 75, 85 form respective ends 11, 13 of the carton 5. The sections 24, 67 and 75, 85 may be perpendicularly disposed with respect to the sections 71, 89, or may be obliquely disposed with respect to the sections 71, 89. The respective side panels 21, 31 may be biased toward the outwardly protruding or open position arrangement described above by the configuration of the respective fold lines 59, 61, 64, 63, 65 and 79, 81, 84, 83, 77.

Referring additionally to FIG. 7, the first closure 8 can be removed from the carton 5 by tearing the top panels 33, 42 along tear lines 39, 35, and 43 such that the top panels 33 and 42 are partially or completely removed from the carton 5 to provide access to the interior space 6 of the carton 5. In this regard, the closed top 7 of the carton 5 is removable from the remainder of the carton 5 and a user may press on the ends 11, 13 of the carton 5 to space the first side panel 21 and second side panel 31 from one another to gain access to the interior space 6 of the carton 5. In the configuration shown, the first side panel 21 and the second side panel 31 protrude outwardly from a longitudinal centerline CL2 extending through the interior space 6 of the carton 5, for example, from the fold line 25 to the fold line 75, with the first side panel 21 and the second side panel 31 converging at the fold lines 25, 75. As shown, the first side panel 21 and the second side panel 31 are generally concave facing the longitudinal centerline CL2 in the outwardly protruding configuration or open position.

Figure 8:
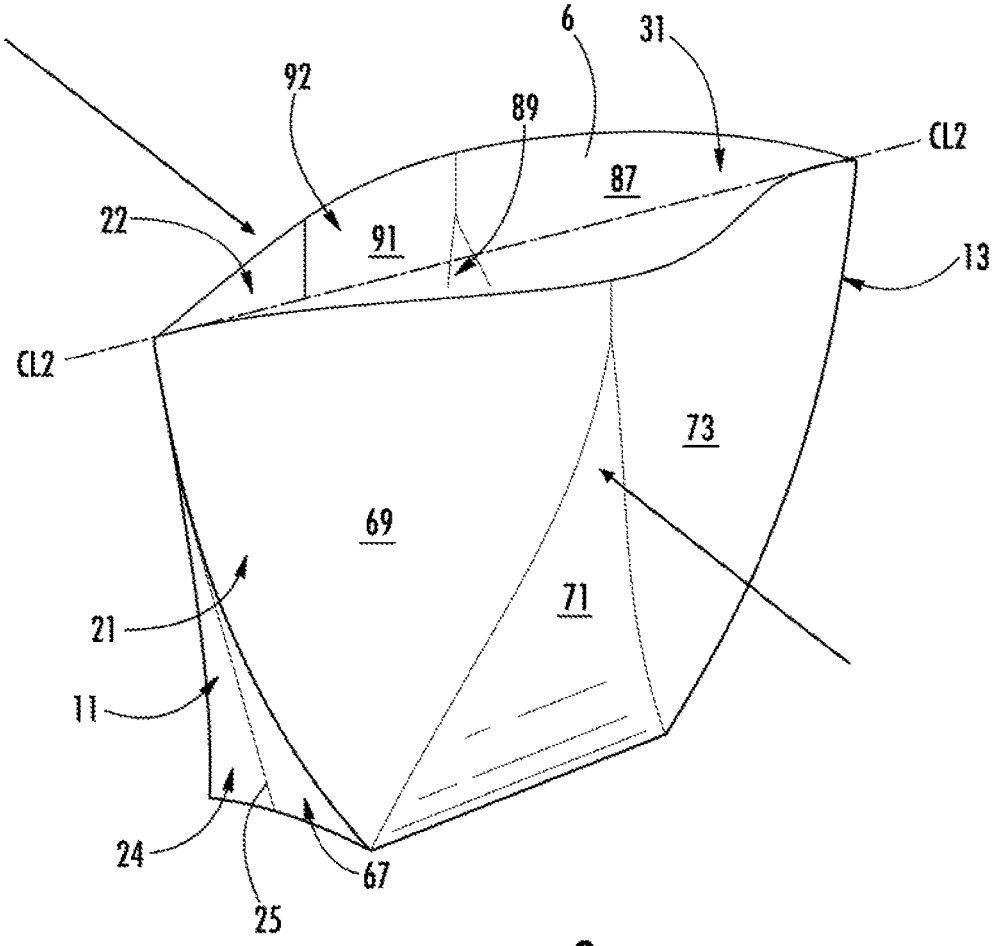
FIG. 8 is a first sequential perspective view of a closure of the carton of FIG. 6 according to an exemplary embodiment of the disclosure.
Figure 9:
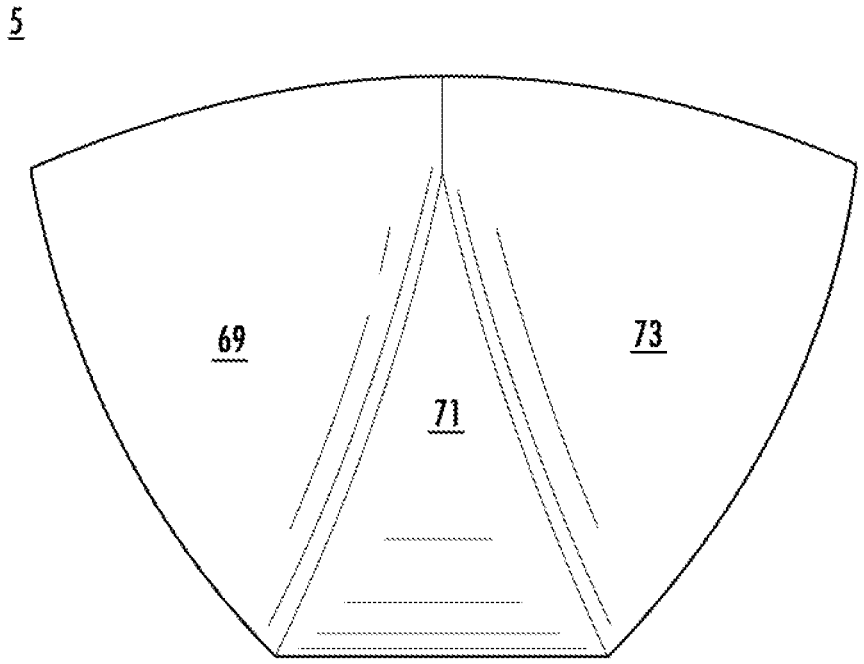
FIG. 9 is a second sequential perspective view of a closure of the carton of FIG. 6 according to an exemplary embodiment of the disclosure.
Figure 10:
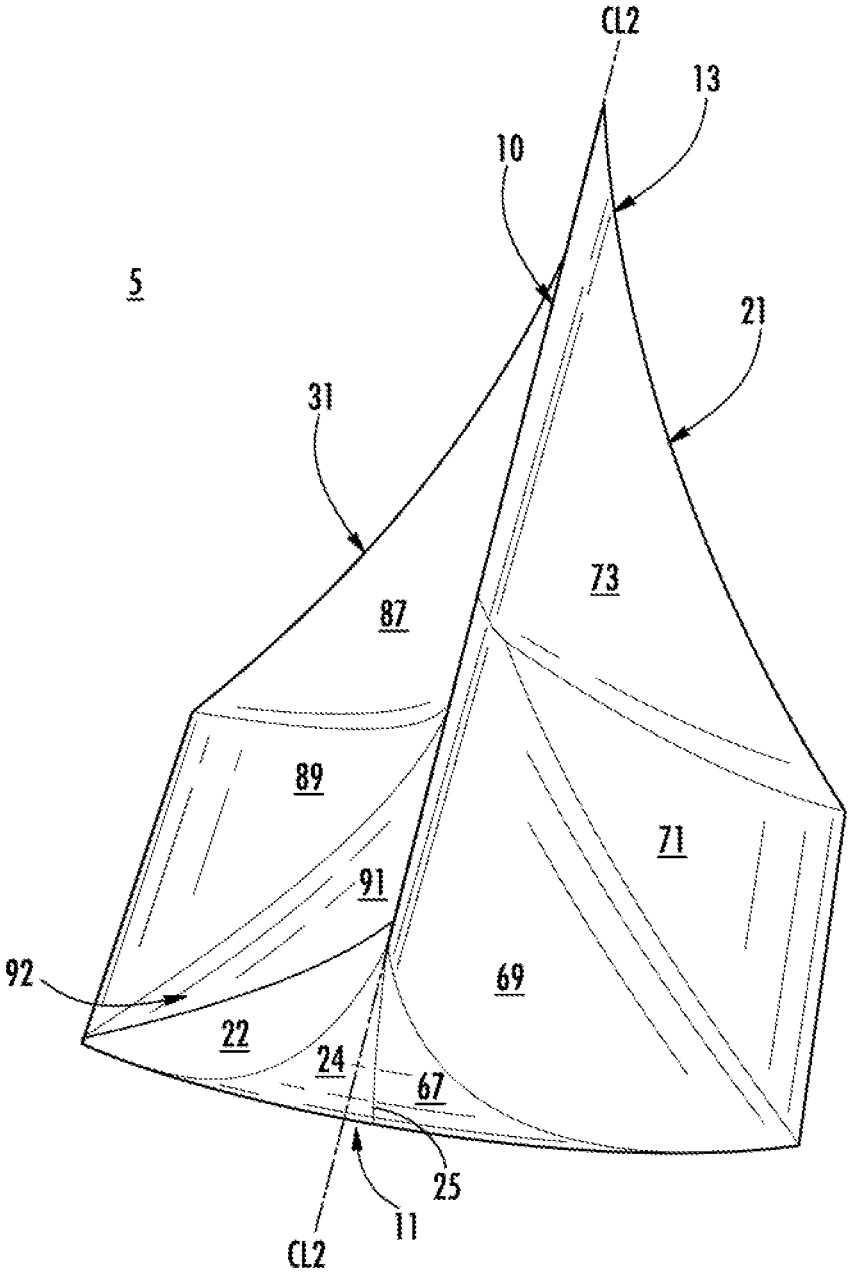
FIG. 10 is a perspective view of the carton of FIG. 6 having a first closure removed and having a second closure closed according to an exemplary embodiment of the disclosure.

Turning to FIGS. 8-10, when it is desired to close carton 5 following removal of the top panels 33, 43, a user can press one or both of the first side panel 21 and the second side panel 31 inwardly as shown such that portions thereof, e.g., the respective sections 69, 71, 73 and 87, 89, 92 reconfigure, e.g., realign, from the outwardly protruding configuration or open position to the inwardly protruding configuration, e.g., inwardly curved or flat, or recessed configuration or closed position in which access to the interior space 6 of the carton 5 is restricted, as shown. Such reconfiguration of the carton 5 is achieved through the flexible arrangement of the respective sections 67, 69, 71, 73, 75 and 85, 87, 89, 92, 24 along respective fold lines 59, 61, 64, 63, 65 and 79, 81, 84, 83, 77. In this regard, portions of the first side panel 21 and the second side panel 31 (e.g., respective sections 69, 71, 73 and 87, 89, 92) can be pressed inwardly, e.g., squeezed, by a user into the inwardly protruding or recessed configuration or closed position in which the first side panel 21 and the second side panel 31 are in at least partial face-to-face contact. The first side panel 21 and the second side panel 31 can be maintained in such an arrangement by the ends 11, 13 of the carton 5, e.g., the sections 24, 67 and the fold line 25, and the sections 75, 85 and the fold line 29, which substantially remain in the outwardly protruding configuration or open position while the sections 69, 71, 73, and 87, 89, 92 are flexed into the inwardly protruding or recessed configuration or closed position such that the ends 11, 13 together brace and provide a compressive force on the sections 69, 71, 73, and 87, 89, 92 to maintain and/or bias such portions of the first side panel 21 and the second side panel 31 in the inwardly protruding or recessed configuration or closed position. In this regard, the sections 69, 71, 73 and 87, 89, 92 are curved inwardly relative to the ends 11, 13 and may have a convex configuration relative to the longitudinal centerline CL2 (FIG. 8).

Such an arrangement of the first side panel 21 and the second side panel 31 presents a valve-like configuration in which the first and second side panels 21, 31 form the second closure 10 sufficient to inhibit the passage of materials between the interior space 6 of the carton 5 and an external environment, for example, passage of articles P or aromas from the articles P (FIG. 4) from the interior space 6 of the carton 5 to the external environment or passage of particulate from the external environment into the interior space 6 of the carton 5, to maintain a desired condition of the articles P in the interior space 6 of the carton 5. While reconfiguration of the carton 5 has been described herein with respect to portions of both of the side panels 21, 31 being pressed into the inwardly protruding or recessed configuration or closed position, in embodiments, portions of one of the first and second side panels 21, 31 may be pressed into the inwardly protruding or recessed configuration or closed position while the other of the first and second side panels 21, 31 is maintained in the outwardly protruding configuration or open position.

Figure 11:
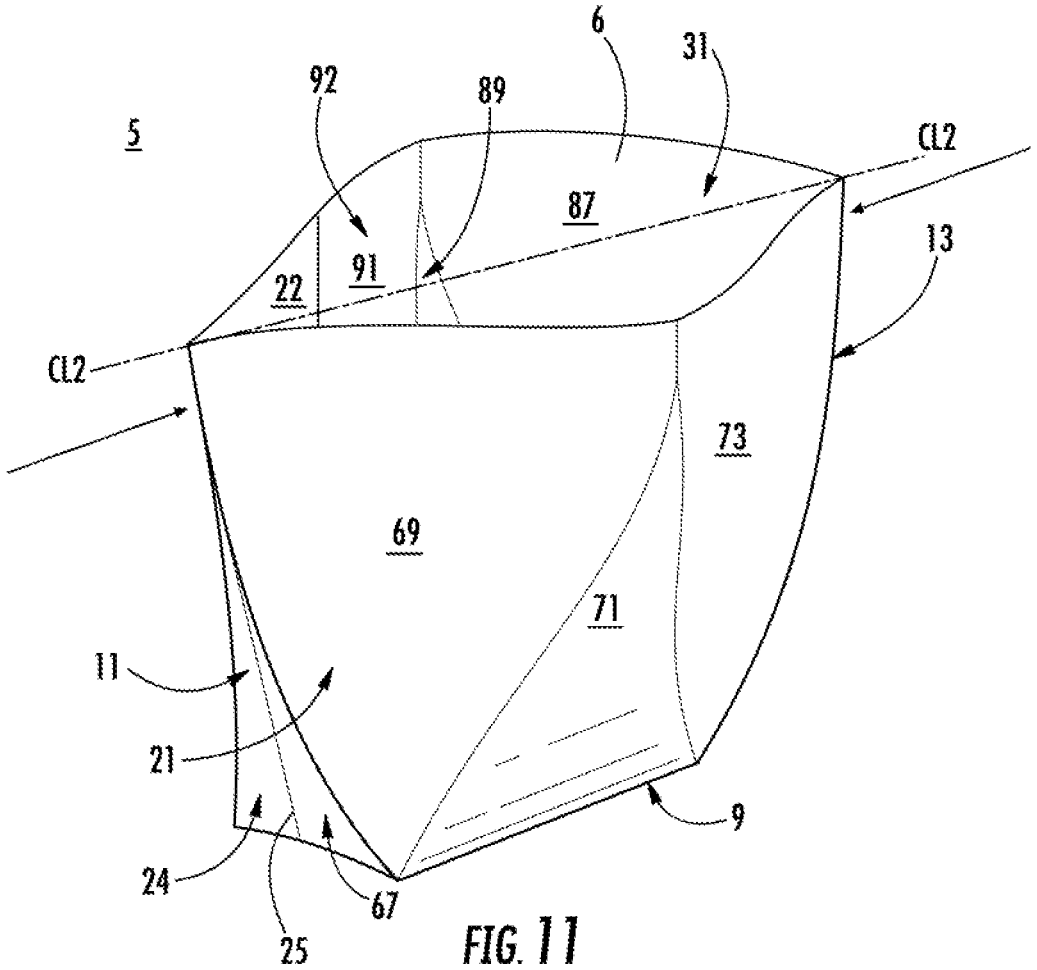
FIG. 11 is a perspective view of an opening of the carton of FIG. 10 according to an exemplary embodiment of the disclosure.

Turning to FIG. 11, should it be desired to again gain access to the interior space 6 of the carton 5 following actuation of the second closure 10 described above, a user can manually separate the side panels 21, 31 into the outwardly protruding arrangements or open position seen in FIG. 6, or the user can alternatively squeeze the carton 5 at the ends 11, 13 to promote separation of the side panels 21, 31 and a return of the respective sections 69, 71, 73 and 87, 89, 92 to their outwardly protruding arrangements or open position.

Any of the features of the various embodiments of the disclosure can be combined with, replaced by, or otherwise configured with other features of other embodiments of the disclosure without departing from the scope of this disclosure. Further, the panels, flaps, and/or other features shown and described in conjunction with the blanks, the cartons, and/or the packages of the above embodiments are included by way of example. The inserts and/or other features of the disclosure can alternatively be associated with any suitable carton or blank having any panel and flap configuration.

The cartons according to the present disclosure can be, for example, formed from blanks of coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels, flaps, or features, adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, comprising:

a plurality of panels at least partially defining an interior space of the carton, the plurality of panels comprising a first side panel and a second side panel foldably connected to the first side panel, at least a portion of the first side panel and at least a portion of the second side panel are reconfigurable between an open position allowing access to the interior space and a closed position wherein the access to the interior space is restricted, the at least a portion of the first side panel comprises a plurality of first sections and the at least a portion of the second side panel comprises a plurality of second sections, the plurality of first sections comprises a central section located on a vertical centerline of the first side panel, two side sections of the first side panel foldably connected to the central section of the first side panel, and two end sections of the first side panel foldably connected to the respective side sections of the first side panel, the plurality of second sections comprises a central section located on a vertical centerline of the second side panel, two side sections of the second side panel foldably connected to the central section of the second side panel, and two end sections of the second side panel foldably connected to the respective side sections of the second side panel; and a plurality of end flaps respectively foldably connected to a respective panel of the plurality of panels, the plurality of end flaps comprising a first top end flap and a second top end flap, the first top end flap foldably connected to the first side panel at a first tear line that defines a top edge of the first side panel, the second top end flap connected to the second side panel at a second tear line that defines a top edge of the second side panel, the first top end flap and the second top end flap forming a top closed end portion of the carton, the top closed end portion is removable from the carton to allow access to the interior space, at least one of the end sections extends to a respective top edge of one of the first side panel and the second side panel.

2. The carton of claim 1, wherein in the open position the at least a portion of the first side panel and the at least a portion of the second side panel protrude outwardly from a centerline of the interior space and are generally concave relative to the centerline of the interior space.

3. The carton of claim 2, wherein in the closed position the at least a portion of the first side panel and the at least a portion of the second side panel are curved inwardly and are generally convex relative to the centerline of the interior space.

4. The carton of claim 3, wherein the at least a portion of the first side panel and the at least a portion of the second side panel converge at the centerline of the interior space.

5. The carton of claim 4, wherein in the closed position the at least a portion of the first side panel and the at least a portion of the second side panel are in face-to-face contact along the centerline of the interior space.

6. The carton of claim 1, wherein the at least a portion of the first side panel and the at least a portion of the second side panel are each biased toward the closed position.

7. The carton of claim 1, wherein each section of each of the plurality of first sections and the plurality of second sections is foldably connected to a respective adjacent section at a fold line.

8. The carton of claim 7, wherein the fold line is curved.

9. The carton of claim 1, wherein the side sections of the first side panel are disposed obliquely inwardly relative to the central section of the first side panel in the open position.

10. The carton of claim 9, wherein the side sections of the second side panel are disposed obliquely inwardly relative to the central section of the second side panel in the open position.

11. The carton of claim 10, wherein each end section is foldably connected to a respective side section at a curved fold line that is generally concave relative to the respective vertical centerline extending through one of the central section of the first side panel and the central section of the second side panel.

12. The carton of claim 11, wherein one end section of the plurality of first sections and one end section of the plurality of second sections are foldably connected to form a first end of the carton.

13. The carton of claim 12, wherein another one end section of the plurality of first sections and another one end section of the plurality of second sections are foldably connected to form a second end of the carton.

14. The carton of claim 13, wherein the first end and the second end maintain the at least a portion of the first side panel and the at least a portion of the second side panel in the closed position.

15. The carton of claim 10, wherein the central section of each of the first side panel and the second side panel are foldably connected to respective adjacent side sections at respective fold lines that are generally convex relative to the respective vertical centerline extending through one of the central section of the first side panel and the central section of the second side panel.

16. The carton of claim 1, wherein the plurality of end flaps is a first plurality of end flaps and the carton further comprises a second plurality of end flaps foldably connected to a respective panel of the plurality of panels, the second plurality of panels is overlapped to form a bottom closed end portion of the carton.

17. The carton of claim 16, wherein in the closed configuration the plurality of first sections and the plurality of second sections extend inwardly from the bottom closed end portion.

18. The carton of claim 16, wherein the configuration of the bottom closed end portion of the carton maintains the at least a portion of the first side panel and the at least a portion of the second side panel in the open position.

19. The carton of claim 1, wherein the first top end flap and the second top end flap are disposed in at least partial face-to-face contact to form the top closed end portion.

20. The carton of claim 1, wherein in the closed position the positioning of the at least a portion of the first side panel and the at least a portion of the second side panel inhibits passage of material between the interior space of the carton and an external environment.

21. A blank for forming carton for holding at least one article, comprising:

a plurality of panels for at least partially defining an interior space of the carton, the plurality of panels comprising a first side panel and a second side panel foldably connected to the first side panel, at least a portion of the first side panel and at least a portion of the second side panel are reconfigurable between an open position allowing access to the interior space and a closed position wherein the access to the interior space is restricted when the carton is formed from the blank, the at least a portion of the first side panel comprises a plurality of first sections and the at least a portion of the second side panel comprises a plurality of second sections, the plurality of first sections comprises a central section located on a vertical centerline of the first side panel, two side sections of the first side panel foldably connected to the central section of the first side panel, and two end sections of the first side panel foldably connected to the respective side sections of the first side panel, the plurality of second sections comprises a central section located on a vertical centerline of the second side panel, two side sections of the second side panel foldably connected to the central section of the second side panel, and two end sections of the second side panel foldably connected to the respective side sections of the second side panel; and a plurality of end flaps respectively foldably connected to a respective panel of the plurality of panels, the plurality of end flaps comprising a first top end flap and a second top end flap, the first top end flap foldably connected to the first side panel at a first tear line that defines a top edge of the first side panel, the second top end flap connected to the second side panel at a second tear line that defines a top edge of the second side panel, the first top end flap and the second top end flap for forming a top closed end portion of the carton when the carton is formed from the blank, the top closed end portion is removable from the carton to allow access to the interior space when the carton is formed from the blank, at least one of the end sections extends to a respective top edge of one of the first side panel and the second side panel.

22. The blank of claim 21, wherein each section of each of the plurality of first sections and the plurality of second sections is foldably connected to a respective adjacent section at a fold line.

23. The blank of claim 22, wherein the fold line is curved.

24. The blank of claim 21, wherein each end section is foldably connected to a respective side section at a curved fold line that is generally concave relative to the respective vertical centerline extending through one of the central section of the first side panel and the central section of the second side panel.

25. The blank of claim 24, wherein one end section of the plurality of first sections and one end section of the plurality of second sections are foldably connected.

26. The blank of claim 25, wherein another one end section of the plurality of first sections and another one end section of the plurality of second sections are foldably connected.

27. The blank of claim 21, wherein the central section of each of the first side panel and the second side panel is foldably connected to respective adjacent side sections at respective fold lines that are generally convex relative to the respective vertical centerline extending through one of the central section of the first side panel and the central section of the second side panel.

28. The blank of claim 21, wherein the plurality of end flaps is a first plurality of end flaps, and the blank further comprises a second plurality of end flaps foldably connected to a respective panel of the plurality of panels for forming a bottom closed end portion of the carton when the carton is formed from the blank.

29. A method of forming a carton for holding at least one article, comprising:

obtaining a blank comprising a plurality of panels, the plurality of panels comprising a first side panel foldably connected to a second side panel, the blank further comprising a plurality of end flaps respectively foldably connected to a respective panel of the plurality of panels, the first side panel comprises a plurality of first sections and the second side panel comprises a plurality of second sections, the plurality of first sections comprises a central section located on a vertical centerline of the first side panel, two side sections of the first side panel foldably connected to the central section of the first side panel, and two end sections of the first side panel foldably connected to the respective side sections of the first side panel, the plurality of second sections comprises a central section located on a vertical centerline of the second side panel, two side sections of the second side panel foldably connected to the central section of the second side panel, and two end sections of the second side panel foldably connected to the respective side sections of the second side panel, the plurality of end flaps comprising a first top end flap and a second top end flap, the first top end flap foldably connected to the first side panel at a first tear line that defines a top edge of the first side panel, the second top end flap connected to the second side panel at a second tear line that defines a top edge of the second side panel, at least one of the end sections extends to a respective top edge of one of the first side panel and the second side panel; and folding the plurality of panels to at least partially define an interior space of the carton and folding the plurality of end flaps to form a top closed end portion that is removable from the carton to allow access to the interior space, the plurality of panels are folded such that at least a portion of the first side panel and at least a portion of the second side panel are folded into an open position allowing access to the interior space and the at least a portion of the first side panel and the at least a portion of the second side panel are folded to be reconfigurable into a closed position wherein access to the interior space is restricted.

30. The method of claim 29, wherein in the open position the at least a portion of the first side panel and the at least a portion of the second side panel protrude outwardly from a centerline of the interior space and are generally concave relative to the centerline of the interior space.

31. The method of claim 30, wherein the at least a portion of the first side panel and the at least a portion of the second side panel converge at the centerline of the interior space.

32. The method of claim 29, wherein each section of the plurality of first sections and the plurality of second sections is foldably connected to a respective adjacent section at a fold line.

33. The method of claim 32, wherein the fold line is curved.

34. The method of claim 29, wherein the side sections of the first side panel are disposed obliquely inwardly relative to the central section of the first side panel in the open position.

35. The method of claim 34, wherein the side sections of the second side panel are disposed obliquely inwardly relative to the central section of the second side panel in the open position.

36. The method of claim 35, wherein each end section is foldably connected to a respective side section at a curved fold line that is generally concave relative to the respective vertical centerline extending through one of the central section of the first side panel and the central section of the second side panel.

37. The method of claim 36, wherein one end section of the plurality of first sections and one end section of the plurality of second sections are foldably connected to form a first end of the carton.

38. The method of claim 37, wherein another one end section of the plurality of first sections and another one end section of the plurality of second sections are foldably connected to form a second end of the carton.

39. The method of claim 34, wherein the central section of each of the first side panel and the second side panel are foldably connected to respective adjacent side sections at respective fold lines that are generally convex relative to the respective vertical centerline extending through one of the central section of the first side panel and the central section of the second side panel.

40. The method of claim 29, wherein plurality of end flaps is a first plurality of end flaps, the top closed end portion is formed by the first plurality of end flaps, and carton further comprises a second plurality of end flaps foldably connected to respective panels of the plurality of panels, the second plurality of panels is overlapped to form a closed bottom end portion of the carton.

41. The method of claim 40, wherein the configuration of the closed bottom end portion of the carton maintains the at least a portion of the first side panel and the at least a portion of the second side panel in the open position.

42. The method of claim 29, wherein the first top end flap and the second top end flap are disposed in at least partial face-to-face contact to form the top closed end portion.

43. A method of forming a carton for holding at least one article, comprising:

obtaining a blank comprising a plurality of panels, the plurality of panels comprising a first side panel foldably connected to a second side panel, the blank further comprising a plurality of end flaps respectively foldably connected to a respective panel of the plurality of panels, the first side panel comprises a plurality of first sections and the second side panel comprises a plurality of second sections, the plurality of first sections comprises a central section located on a vertical centerline of the first side panel, two side sections of the first side panel foldably connected to the central section of the first side panel, and two end sections of the first side panel foldably connected to the respective side sections of the first side panel, the plurality of second sections comprises a central section located on a vertical centerline of the second side panel, two side sections of the second side panel foldably connected to the central section of the second side panel, and two end sections of the second side panel foldably connected to the respective side sections of the second side panel, the plurality of end flaps comprising a first top end flap and a second top end flap, the first top end flap foldably connected to the first side panel at a first tear line that defines a top edge of the first side panel, the second top end flap connected to the second side panel at a second tear line that defines a top edge of the second side panel, at least one of the end sections extends to a respective top edge of one of the first side panel and the second side panel;

folding the plurality of panels to at least partially define interior space of the carton and folding the plurality of end flaps to form a top closed end portion that is removable from the carton to allow access to the interior space, the plurality of panels are folded such that at least a portion of the first side panel and at least a portion of the second side panel are folded into an open position allowing access to the interior space; and reconfiguring the at least a portion of the first side panel and the at least a portion of the second side panel into a closed position wherein access to the interior space is restricted.

44. The method of claim 43, wherein in the closed position the at least a portion of the first side panel and the at least a portion of the second side panel are curved inwardly and are generally convex relative to the centerline of the interior space.

45. The method of claim 43, wherein the at least a portion of the first side panel and the at least a portion of the second side panel are each biased toward the closed position.

46. The method of claim 43, wherein the side sections of the first side panel are disposed obliquely inwardly relative to the central section of the first side panel in the open position.

47. The method of claim 46, wherein the side sections of the second side panel are disposed obliquely inwardly relative to the central section of the second side panel in the open position.

48. The method of claim 47, wherein one end section of the plurality of first sections and one end section of the plurality of second sections are foldably connected to form a first end of the carton and another one end section of the plurality of first sections and another one end section of the plurality of second sections are foldably connected to form a second end of the carton.

49. The method of claim 48, wherein the first end and the second end maintain the first side panel and the second side panel in the closed position.

50. The method of claim 43, wherein in the closed position the positioning of the at least a portion of the first side panel and the at least a portion of the second side panel inhibits passage of material between the interior space of the carton and an external environment.

* * * * *